US010370946B2

(12) United States Patent
Malbrel et al.

(10) Patent No.: US 10,370,946 B2
(45) Date of Patent: Aug. 6, 2019

(54) INTAKE SCREEN ASSEMBLY FOR SUBMERSIBLE WELL PUMP

(71) Applicant: Baker Hughes Incorporated, Houston, TX (US)

(72) Inventors: Christophe Malbrel, Houston, TX (US); Elmer Peterson, Porter, TX (US)

(73) Assignee: Baker Hughes, a GE Company, LLC, Houston, TX (US)

( * ) Notice: Subject to any disclaimer, the term of this patent is extended or adjusted under 35 U.S.C. 154(b) by 62 days.

(21) Appl. No.: 15/386,176

(22) Filed: Dec. 21, 2016

(65) Prior Publication Data

US 2018/0171763 A1 Jun. 21, 2018

(51) Int. Cl.

| | |
|---|---|
| ***E21B 43/12*** | (2006.01) |
| ***E21B 34/06*** | (2006.01) |
| ***E21B 34/08*** | (2006.01) |
| ***E21B 43/08*** | (2006.01) |
| ***E21B 34/00*** | (2006.01) |

(52) U.S. Cl.

CPC ..... *E21B 43/128* (2013.01); *E21B 34/063* (2013.01); *E21B 34/08* (2013.01); *E21B 43/084* (2013.01); *E21B 2034/007* (2013.01)

(58) Field of Classification Search

CPC ..... E21B 43/08; E21B 34/063; E21B 34/08; E21B 43/128

See application file for complete search history.

(56) References Cited

U.S. PATENT DOCUMENTS

| | | | | |
|---|---|---|---|---|
| 6,533,033 | B2 | 3/2003 | Skillman | |
| 7,503,389 | B2 | 3/2009 | Delaloye et al. | |
| 2006/0016744 | A1* | 1/2006 | Miner | B01D 35/26 210/416.1 |
| 2009/0078428 | A1 | 3/2009 | Ali | |
| 2009/0133882 | A1 | 5/2009 | Delaloye et al. | |
| 2011/0030965 | A1 | 2/2011 | Coronado | |
| 2011/0030969 | A1 | 2/2011 | Richards | |
| 2014/0262324 | A1 | 9/2014 | Greci et al. | |
| 2015/0047837 | A1* | 2/2015 | Turner | E21B 43/14 166/254.2 |
| 2015/0068743 | A1 | 3/2015 | Broussard et al. | |
| 2015/0330191 | A1 | 11/2015 | Holderman | |
| 2016/0281459 | A1* | 9/2016 | Stautzenberger | E21B 33/04 |

OTHER PUBLICATIONS

International Search Report and Written Opinion dated Feb. 26, 2018 for corresponding PCT/US2017/064473.

* cited by examiner

*Primary Examiner* — David J Bagnell
*Assistant Examiner* — Manuel C Portocarrero
(74) *Attorney, Agent, or Firm* — Bracewell LLP; James E. Bradley

(57) ABSTRACT

A well fluid particle screen assembly includes a base pipe having first and second pipe segments. First and second sets of perforations are located in sidewalls of the first and second pipe segments. First and second screens are mounted around the first and second pipe segments. A second pipe segment valve mounted to the second pipe segment has a closed position blocking well fluid flow through the second set of perforations. The second pipe segment valve has a pressure area acted on by a well fluid pressure differential. When reaching a threshold, the pressure differential causes the second pipe segment valve to move from the closed position to an open position. A retainer retains the second pipe segment valve in the closed position until the threshold is reached.

20 Claims, 4 Drawing Sheets

INTAKE SCREEN ASSEMBLY FOR SUBMERSIBLE WELL PUMP

FIELD OF THE DISCLOSURE

This disclosure relates in general to sand screens used in hydrocarbon producing wells, and in particular to an intake screen for a submersible well pump for screening proppants.

BACKGROUND

Electrical submersible pumps ("ESP") are commonly used to pump well fluid from hydrocarbon producing wells that lack sufficient formation pressure to flow naturally. A typical ESP has an electrical motor that drives a rotary pump. The pump may be either a centrifugal pump or another type, such as a progressive cavity type.

Some well produce a significant quantity of sand along with the well fluid. Also, wells that have been hydraulically fractured ("fracked"), may produce proppants along with the well fluid. The proppants comprise ceramic or sand particles previously pumped into fissures in the earth formation under high pressure.

The sand and/or proppants can cause abrasive wear of the components of the pump. Various techniques are used to reduce the wear, such as employing tungsten carbide components along the flow paths through the pump. Also, if a large quantity of proppants enters the intake at a given moment, the pump can stall. Wells producing slugs of gas can also entrain large quantities of the proppants in the slugs of gas.

It is known to employ screens to filter the proppants from the pump intake. However, the proppants may accumulate on and clog the screen, requiring an operator to pull the ESP and screen from the well for cleaning or replacement.

SUMMARY

A well fluid particle screen assembly has a base pipe having an axis, a closed lower end, and an open upper end for attachment to a well pump intake structure within a well. The base pipe has a first pipe segment and a second pipe segment. First and second sets of perforations are in sidewalls of the first and second pipe segments, respectively. First and second screens are mounted around the first and second pipe segments, respectively, for screening particulates in well fluid flowing to the first and second sets of perforations. A second pipe segment valve is mounted to the second pipe segment and has a closed position blocking well fluid flow through the second set of perforations from the second pipe segment into the first pipe segment. The second pipe segment valve is movable to an open position allowing well fluid flow through the second set of perforations from the second pipe segment into the first pipe segment. The second pipe segment valve has a pressure area acted on by a pressure differential between an interior and an exterior of the second pipe segment in response to suction of a well pump. When reaching a selected second pipe segment valve minimum, the pressure differential causes the second pipe segment valve to move from the closed position to the open position. A second pipe segment valve retainer retains the second pipe segment valve in the closed position until the pressure differential reaches the selected second pipe segment valve minimum, which indicates that flow through the first screen and the first set of perforations has declined due to clogging of the first screen.

In the embodiment shown, the second pipe segment valve retainer comprises means for shearing in response to the pressure differential reaching the selected second pipe segment valve minimum. For example, the second pipe segment valve retainer may comprise at least one shear pin.

The second pipe segment valve may comprise a sleeve located between the second screen and the set of perforations, the sleeve being axially slidable from the closed to the open position.

A third pipe segment may be connected to the second pipe segment. The third pipe segment has a third set of perforations and a third screen. A third pipe segment valve mounted to the third pipe segment has a closed position blocking well fluid flow through the third set of perforations. The third pipe segment valve is movable to an open position allowing well fluid flow through the third set of perforations. The third pipe segment valve has a pressure area acted on by a pressure differential between an interior and an exterior of the third pipe segment that urges the third pipe segment valve to move from the closed position to the open position. A third pipe segment valve retainer retains the third pipe segment valve in the closed position until the pressure differential acting on the third pipe segment valve reaches a selected third pipe segment valve minimum that is greater than the selected second pipe segment valve minimum. Reaching the third minimum indicates that flow through the second screen and the second set of perforations has declined due to clogging of the second screen.

Each of the first and second pipe segment valve retainers may comprise a shear member arrangement. The shear member arrangement of the second pipe segment valve retainer is configured to shear at a lesser force than the shear member arrangement of the first pipe segment valve retainer.

The first pipe segment may be configured such that the first set of perforations is continuously open to well fluid flow into an interior of the first pipe segment. In the embodiment shown, the first set of perforations are located nearer an upper end of the first pipe segment than a lower end. The sidewall of the first pipe segment is free of perforations from the lower end of the first pipe segment to the first set of perforations.

Figure 1A:
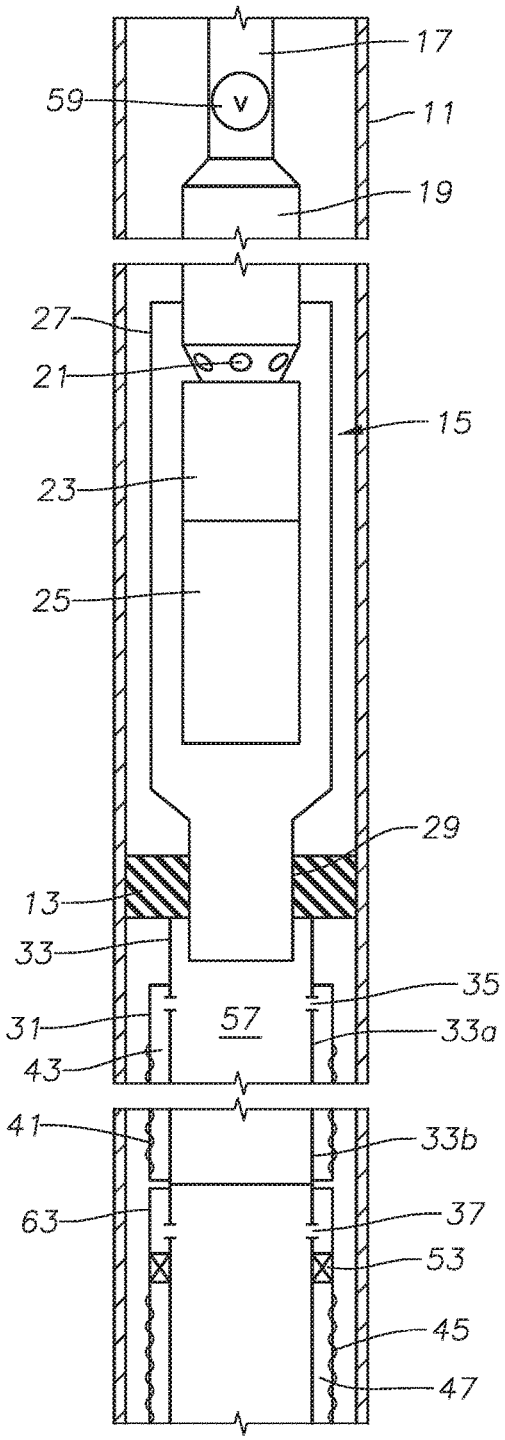
FIGS. 1A and 1B comprise a schematic sectional view of a well fluid pump assembly in accordance with this disclosure.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF THE DISCLOSURE

The method and system of the present disclosure will now be described more fully hereinafter with reference to the accompanying drawings in which embodiments are shown. The method and system of the present disclosure may be in many different forms and should not be construed as limited to the illustrated embodiments set forth herein; rather, these embodiments are provided so that this disclosure will be thorough and complete, and will fully convey its scope to those skilled in the art. Like numbers refer to like elements throughout.

It is to be further understood that the scope of the present disclosure is not limited to the exact details of construction, operation, exact materials, or embodiments shown and described, as modifications and equivalents will be apparent to one skilled in the art. In the drawings and specification, there have been disclosed illustrative embodiments and, although specific terms are employed, they are used in a generic and descriptive sense only and not for the purpose of limitation.

Figure 1B:
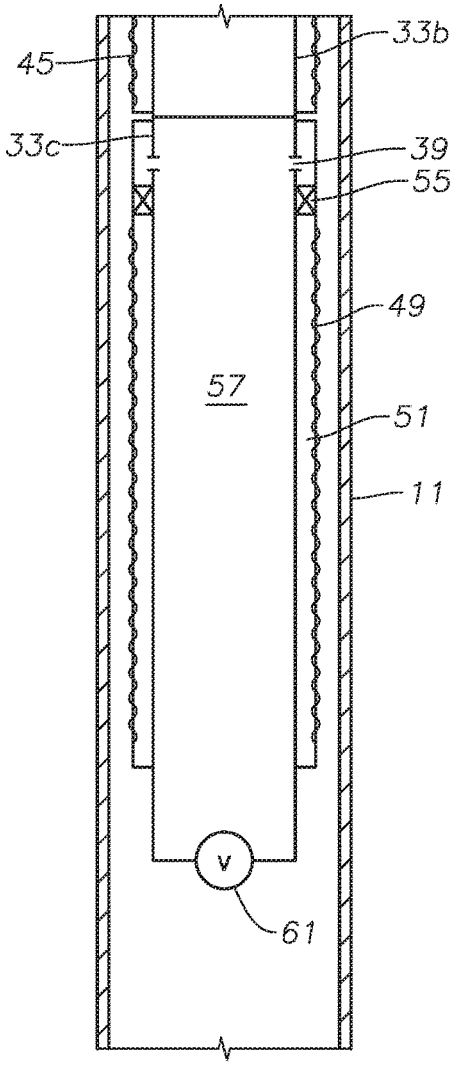

FIGS. 1A and 1B illustrate a vertical part of a well having casing 11 cemented in the wellbore. Casing 11 may extend around a bend into a horizontal or highly inclined portion (not shown) of the well. The inclined portion of casing 11 has openings or perforations (not shown) for admitting well fluid from an earth formation. In this example, the earth formation or formations has undergone a hydraulic fracturing process ("fracking") wherein a large quantity of proppants have been pumped into fissures created by the high pressure imposed during the fracking process. The proppants, also referred as sand, comprise small ceramic particles. As the well begins producing, significant quantities of the proppants may flow into casing 11 along with the well fluid.

In this example, the operator has set a packer 13 in the vertical portion of casing 11. An electrical pump assembly 15 ("ESP") is then installed with production tubing 17 above packer 13. ESP 15 includes a pump 19, which may be a centrifugal pump having a large number of stages, each stage comprising a rotating impeller and a stationary diffuser. Alternately, pump 19 could be other types, such as a progressive cavity pump or a linear reciprocating pump. Pump 19 has an intake 21 on its lower end. A seal section 23 connects to the lower end of intake 21. A motor 25 connects to a lower end of seal section 23.

Motor 25 is typically a three-phase electrical motor filled with a dielectric lubricant. Motor 25 has a shaft (not shown) that connects to a shaft (not shown) in seal section 23. The shaft in seal section 23 couples to a shaft in pump 19 for driving pump 19. Seal section 23 has a shaft seal to seal well fluid from entry into motor 25. Seal section 23 may also have a thrust bearing for handling down thrust imposed on the shaft of pump 19. Typically, the thrust bearing is in fluid communication with the lubricant in motor 25. A pressure equalizer reduces a pressure differential between the hydrostatic pressure of the well fluid in casing 11 and the lubricant in motor 25. The pressure equalizer may be part of seal section 23 or located below motor 25.

In this example, a shroud 27 encloses motor 25, seal section 23 and at least intake 21 portion of pump 19. The upper end of shroud 27 seals to pump 19 above intake 21. A power cable (not shown) extends downward alongside production tubing 17 and through a sealed port in shroud 27 to motor 25 to supply power to motor 25. An intake tube or stinger 27 of smaller diameter than the upper portion of shroud 27 extends downward from shroud 27 and stabs sealingly into a polished bore receptacle of packer 13. Shroud 27 is lowered on production tubing 17 along with pump 19, seal section 23, and motor 25. Packer 13 comprises a supporting structure for ESP assembly 15 and may be considered to be part of an intake assembly for ESP assembly 15.

Packer 13 also supports a screen assembly 31 to screen well fluid flowing into stinger 27. Other arrangements are feasible, including running screen assembly 31 with ESP assembly 15 rather than installing a packer 13 prior to running ESP assembly 15. In this embodiment, screen assembly 31 includes a base pipe 33 that secures to the lower side of packer 13 and is supported by packer 13. Base pipe 33 is made up of more than one pipe segment, and this embodiment shows three, a first or upper pipe segment 33*a*, a second or intermediate pipe segment 33*b*, and a lower or third pipe segment 33*c*. Pipe segments 33*a*, 33*b*, and 33*c* may be joined to each other in various manners, such as by threaded arrangements. Each pipe segment 33*a*, 33*b* and 33*c* may vary in length, such as up to about 40 feet. Base pipe 33 could have more or less than three pipe segments.

First pipe segment 33*a* has a first set of perforations 35 through its sidewall. Second pipe segment 33*b* has a second set of perforations 37 through its sidewall. Third pipe segment 33*c* has a third set of perforations 39 through its sidewall. Each set of perforations 35, 37 and 39 may comprise one or more circumferential row of apertures.

In this embodiment, first perforations 35 are located near the upper end of first pipe segment 33*a*, and all of first perforations 35 are much closer to the upper end than the lower end of first pipe segment 33*a*. The portion of first pipe segment 33*a* that extends from the lower end to first perforations 35 is free of perforations or openings in the sidewall. For example, first perforations 35 may be only a couple of feet or less from the upper end of first pipe segment 33*a*, while the lower portion free of any perforations may be 35 feet or more. Similarly, second perforations 37 are located near the upper end of second pipe segment 33*b*, and all of the perforations in second pipe segment 33*b* are much closer to the upper end than the lower end of second pipe segment 33*b*. The portion of second pipe segment 33*b* that extends from the lower end to second perforations 37 is free of perforations or openings in the sidewall. In the same manner, third perforations 39 are located near the upper end of third pipe segment 33*c*, and all of the perforations in third pipe segment 33*c* are much closer to the upper end than the lower end of third pipe segment 33*c*. The portion of third pipe segment 33*c* that extends from the lower end to third perforations 39 is free of perforations or openings in the sidewall.

A first screen 41 surrounds and is secured to first pipe segment 33*a* by upper and lower connectors. First screen 41 is a cylindrical mesh screen that is concentric with first pipe segment 33*a* and spaced radially outward, defining a first annulus 43 between them. The upper connector joins first screen 41 to the sidewall of first pipe segment 33*a* above first perforations 35, defining an upper end of first annulus 43. The lower connector joins first screen 41 to the sidewall of first pipe segment 33*a* near the lower end of first pipe segment 33*a*, defining a lower end of first annulus 43. First screen 41 may extend most of the length of first pipe segment 33*a*.

A second screen 45 surrounds and is secured to second pipe segment 33*b* by upper and lower connectors. Second screen 45 is a cylindrical mesh screen that is concentric with second pipe segment 33*b* and spaced radially outward, defining a second annulus 47 between them. The upper connector joins second screen 45 to the sidewall of second pipe segment 33*a* above second perforations 37, defining an upper end of second annulus 47. The lower connector joins second screen 45 to the sidewall of second pipe segment 33*b* near the lower end of second pipe segment 33*b*, defining a lower end of second annulus 47. Second screen 45 may extend most of the length of second pipe segment 33*b*.

A third screen 49 surrounds and is secured to third pipe segment 33*c* by upper and lower connectors. Third screen 49 is a cylindrical mesh screen that is concentric with third pipe segment 33*c* and spaced radially outward, defining a third annulus 51 between them. The upper connector joins third screen 49 to the sidewall of third pipe segment 33*c* above third perforations 39, defining an upper end of third annulus 51. The lower connector joins third screen 49 to the sidewall of third pipe segment 33*c* near the lower end of third pipe segment 33*c*, defining a lower end of third annulus 51. Third screen 49 may extend most of the length of third pipe segment 33*c*.

Second screen 45 has a second pipe segment valve 53 to close and open a flow path from second annulus 47 to second perforations 37. In this example, second pipe segment valve 53 is located in the upper portion of second annulus 47. While in the closed position, which is shown in FIG. 1A, second pipe segment valve 53 is located below second perforations 37, blocking all flow from second screen 45. While in the open position of FIG. 3, second pipe segment valve 53 is located above second perforations 37, allowing flow through second screen 45 and second perforations 37.

Third screen 49 may be identical to second screen 45, having a third pipe segment valve 55 to close and open a flow path from third annulus 51 to third perforations 39. Third pipe segment valve 55 is located in the upper portion of third annulus 51. While in the closed position shown in FIG. 1B, third pipe segment valve 55 is located below third perforations 39, blocking all flow from third screen 49. While in the open position, (not shown), third pipe segment valve 55 is located above third perforations 39, allowing flow through third screen 49 and third perforations 39.

As will be explained in more detail below, second and third pipe segment valves 53, 55 are movable from the lower closed position to the upper open position in response to a pressure differential between the well fluid pressure on the exterior of second and third screens 45, 49 and the fluid pressure in base pipe flow passage 57. Also, second and third pipe segment valves 53, 55 are retained such that second pipe segment valve 53 moves to the open position only after first screen 41 has clogged significantly. The retainer for third pipe segment valve 55 remains closed and only moves to the open position after second screen 45 has clogged significantly.

In this embodiment, first screen 41 does not employ a valve between first screen 41 and first perforations 35. Rather, the flow path from first annulus 43 through first perforations 35 is continuously open. First, second and third perforations 35, 37 and 39 lead to flow passage 57 extending upward from third pipe segment 33*c*, second pipe segment 33*b*, and first pipe segment 33*a* to shroud stinger 29.

Production tubing 17 optionally may have an upper valve 59 located above the discharge of pump 19. Valve 59 closes when pump 19 shuts down in order to prevent proppants and other particles entrained in the well fluid in production tubing 17 from falling back down into pump 19. Valve 59 may be a commercially available type and may have other features, such as an ability for an operator to pump the captured proppants back up production tubing 17 while pump 19 is shut down. For example, this procedure may be done by pumping fluid down the annulus in casing surrounding production tubing 17 and through a port in upper valve 59.

The lower end of base pipe 33 is closed, as shown in FIG. 1B. A bypass valve 61 may be located in the closed lower end to open in the event all three screens 41, 45 and 49 are significantly clogged. Bypass valve 61 may be a type having a spring biased valve element (not shown) that moves upward to open if the pressure differential between the lower and upper sides of the valve element is high enough. That event would occur if all three screens 41, 45 and 49 are significantly clogged, allowing well fluid to flow directly up flow passage 57 to pump intake 21, bypassing screens 41, 45 and 49.

Figure 2:
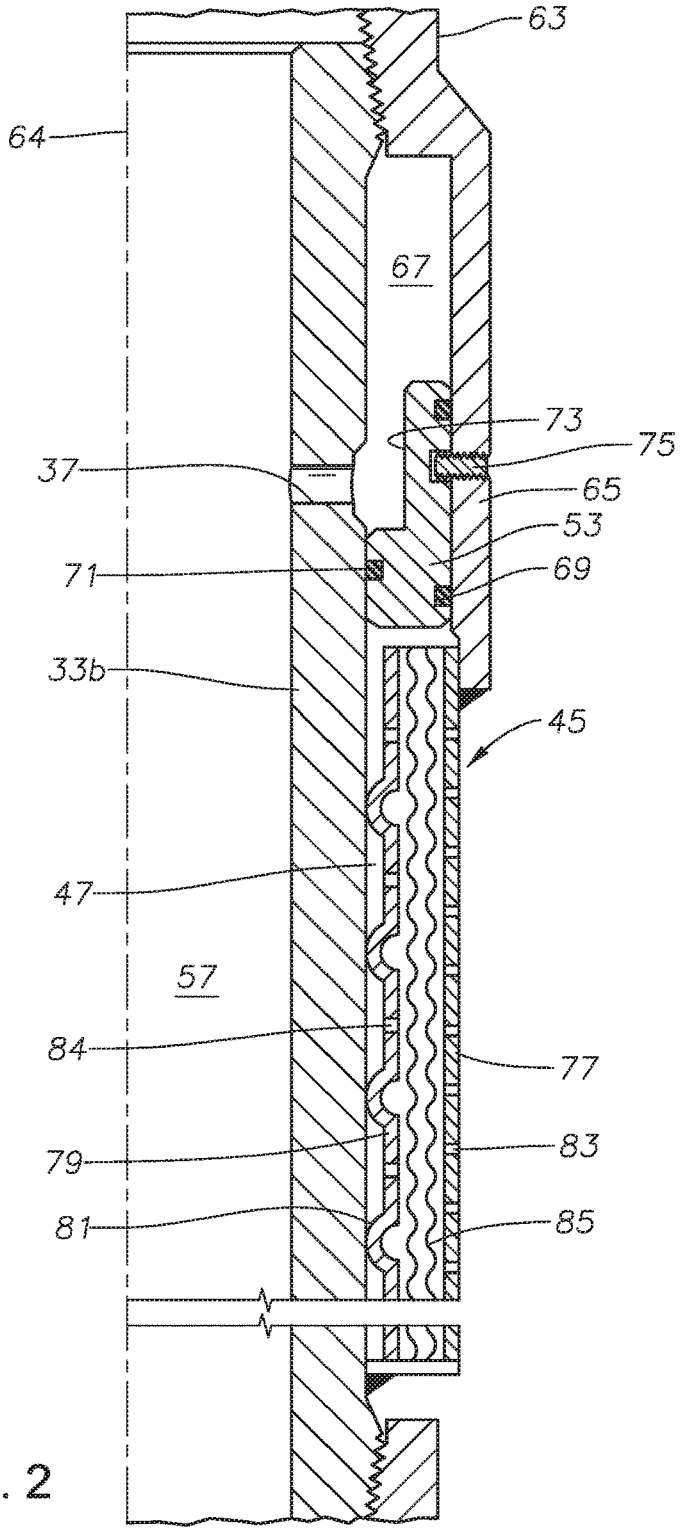
FIG. 2 is an enlarged sectional view of a second screen of the assembly of FIGS. 1A and 1B, showing a sleeve valve in a closed position.
Figure 3:
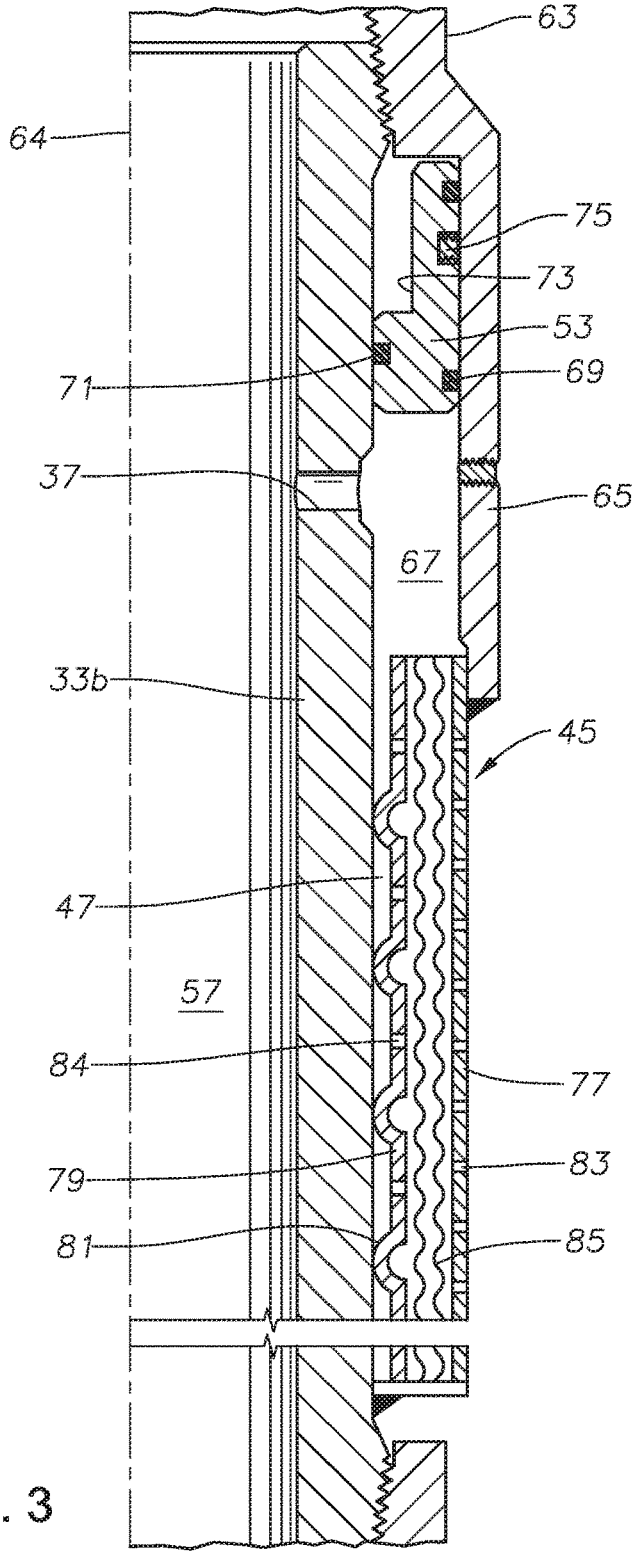
FIG. 3 is a sectional view of the second screen of FIG. 2, but showing the sleeve valve in an open position.

Referring to FIGS. 2 and 3, a second pipe segment connector 63 has a threaded upper end that secures to first base pipe segment 33*a* (FIG. 1A). Second pipe segment connector 63 has a lower end that secures to the upper end of second screen 49, such as by a weld. For uniformity, first pipe segment 33*a* could have a connector the same as connector 63, except a sliding valve sleeve would not be used.

Second pipe segment connector 63 has a cylindrical wall 65 concentric with second pipe segment 33*b* and spaced radially outward relative to axis 64. Cylindrical wall 65 and second pipe segment 33*b* define a second pipe segment valve chamber 67 that is closed at the top by connector 63 and open at the bottom to second annulus 47. The upper end of second pipe segment valve chamber 67 is above second perforations 37, and the lower end is below second perforations 37.

Second pipe segment valve 53 is a sleeve that is slidably and sealingly carried in valve chamber 67. Second pipe segment valve 53 has one or more seal rings 69 (two shown) that seal its outer diameter to the inner surface of pressure chamber wall 65. Second pipe segment valve 53 has at least one seal ring 71 on its inner diameter that seals its inner diameter to the outer surface of second pipe segment 33*b*. Second pipe segment valve 53 has a pressure area on its lower end that extends from inner diameter seal ring 71 to outer diameter seal ring 69. Second pipe segment valve 53 optionally may have a relief area 73 of smaller radial thickness in its upper portion. While in the closed position shown in FIG. 2, relief area 73 is located radially outward from second perforations 37.

A retainer, which in this example comprises one or more shear pins 75, holds second pipe segment valve 53 in the closed position until the pressure difference between the pressure in second annulus 47 and in flow passage 57 increases to a minimum level. Once the minimum level is reached, shear pins 75 will shear, enabling the pressure differential to push second pipe segment valve 53 to the upper open position shown in FIG. 3. Other types of retainers are feasible, such as a protruding detent or a spring biasing second pipe segment valve 53 downward.

Third pipe segment valve 55 (FIG. 1B) may be constructed in the same manner as second pipe segment valve 53. However, the retainer will be configured to hold third pipe segment valve 55 in the closed position until being subjected to a higher pressure differential than the pressure differential that moves second pipe segment valve 53 to the open position. For example, more of the same size of shear pins 75 could be employed for third pipe segment valve 55 than second pipe segment valve 53. Alternately, shear pins 75 having a greater shear strength could be used for third pipe segment valve 55.

Second screen 45 in this embodiment has a cylindrical outer screen tube 77 and a cylindrical inner screen tube 79. Inner screen tube 79 may have dimples 81 protruding radially inward that contact the outer surface of second pipe segment 33*b* to maintain a desired radial width for second annulus 47. Outer screen tube 77 has a large number of apertures 83, which are normally circular, throughout its surface. Inner screen tube 79 has similar apertures 84.

Figure 4:
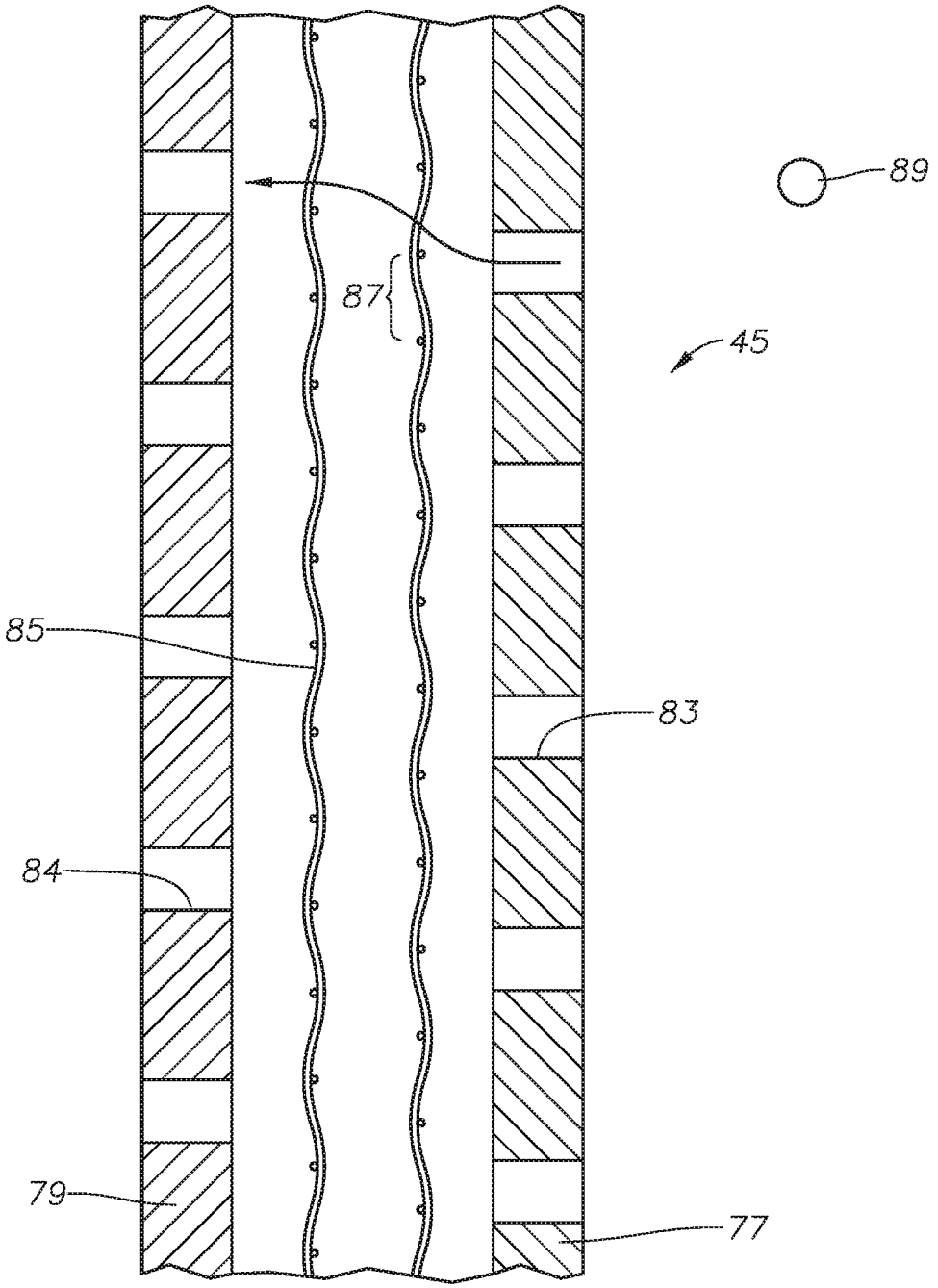
FIG. 4 is a schematic view of part of the second screen of FIG. 2.

Two or more sheets of woven cloth 85, typically metal, are located between outer and inner screen tubes 77, 79. Other screen layers may be included, and normally the woven cloth layers 85 will be radially separated from each other a short distance as well as from outer and inner tubes 77, 79. Referring to FIG. 4, the weave of each woven cloth layer 85 creates apertures 87, which normally will not be circular. In this embodiment, apertures 83, 84 in outer and inner tubes 77, 79 are sized to be larger than the average diameter of proppants 89, which are typically generally spherical ceramic particles. Typical proppants 89 may be about 100 mesh, which results in a diameter of about 0.00059 inch or 149 microns. The areas of cloth apertures 87 are sized so as to allow an average size proppant 89 to pass through. For example, cloth layers 85 sized at 280 microns or micrometers may be employed. However, due to the construction of second screen 45, many of the apertures 83, 84 and 87 will not radially align with each other. Many of the partially aligned apertures 83, 84 and 87 will have an effective flow path dimension less than the average diameter size of proppants 89. As indicated by the curved arrow, a path for a proppant 89 from outer tube aperture 83 through woven cloth apertures 87 and out an inner tube aperture 84 will often be torturous. The tortuous path impedes the progress of proppants 89, slowing down and metering the millions of proppants 89 that may be flowing into base pipe 87.

Referring again to FIGS. 1A and 1B, during initial operation, second and third pipe segment valves 53, 55 are closed. Supplying power to motor 25 drives pump 19, which creates a suction in flow passage 57. The suction may vary, and for example, it could create a pressure in flow passage 57 about 20-25 psi less than in casing 11 surrounding first, second, and third screens 41, 45 and 49. The suction pressure causes well fluid to flow through first screen 41 and first perforations 35 into flow passage 57, but not through second and third screens 45, 49 because of the closed valves 53, 55. The well fluid flows up to pump intake 21, and pump 19 increases the pressure and discharges the well fluid up production tubing 17. Because first screen 41 will initially be clean, the pressure differential created by pump 19 will not be enough to cause second and third pipe segment valves 53, 55 to open.

Some proppants 89 (FIG. 4) will likely be in the well fluid, and first screen 41 will block or at least impede the flow of proppants 89 into flow passage 57. Pump 19 is capable of pumping a metered amount of proppants 89, but if the quantity greatly increases at a particular moment, pump 19 could stall. If the well is producing gas in intermittent slugs, larger quantities of proppants 89 could be present in those gas slugs. First screen 41 will meter a flow of proppants 89 into flow passage 57 even during gas slugs.

Eventually, however, proppants 89 will begin to be trapped within and on the exterior of first screen 41. The clogging of first screen 41 tends to build up first at the upper end, near first perforations 35, resulting in an accumulation on the exterior of first screen enlarging toward casing 11. The accumulation reduces the flow area between first screen 41 and casing 11. Having first perforations 35 only at the upper end of a long first annulus 43 reduces the tendency for proppants to build up first on the exterior of lower or middle sections of first screen 41.

Eventually proppants 89 and other debris may accumulate on and in much of the length of first screen 41. This clogging of first screen 41 increases the differential pressure on second and third pipe segment valves 53, 55. The pressure differential will cause shear pins 75 of second valve 53 to shear, pushing second pipe segment valve 53 up to the open position of FIG. 3. The pressure differential acting on third pipe segment valve 55 will not yet be high enough to shear its shear pins 75 because there are more of them.

Pump 19 continues to pump well fluid in the same manner, with second screen 45 metering the flow of proppants 89 in the same manner as previously performed by first screen 41. A diminished amount of well fluid may continue to flow through first screen 41. Eventually, proppants 89 and other debris may accumulate on second screen 45 sufficiently to cause the pressure differential on third pipe segment valve 55 to move valve 55 to the open position. Third screen 49 will then screen proppants in the same manner as previously performed by first and second screens 41, 45. Second pipe segment valve 53 will remain open, allowing a diminished flow of well fluid through second screen 45.

The present invention described herein, therefore, is well adapted to carry out the objects and attain the ends and advantages mentioned, as well as others inherent therein. While only a few embodiments of the invention have been given for purposes of disclosure, numerous changes exist in the details of procedures for accomplishing the desired results. These and other similar modifications will readily suggest themselves to those skilled in the art, and are intended to be encompassed within the spirit of the present invention disclosed herein and the scope of the appended claims.

The invention claimed is:

1. A well fluid particle screen assembly for a well pump, comprising:

a base pipe having an axis, a closed lower end, and an open upper end for attachment to a well pump intake structure of the well pump within a well;

the base pipe having a first pipe segment and a second pipe segment, one of the segments being above the other of the segments;

first and second sets of perforations in sidewalls of the first and second pipe segments, respectively;

first and second screens mounted around the first and second pipe segments, respectively, for screening particulates in well fluid flowing to the first and second sets of perforations, respectively;

a second pipe segment valve mounted to the second pipe segment and having a closed position blocking well fluid flow through the second set of perforations from the second pipe segment into the first pipe segment and to the well pump intake structure, the second pipe segment valve being movable to an open position allowing well fluid flow through the second set of perforations from the second pipe segment into the first pipe segment and to the well pump intake structure;

the second pipe segment valve having an interior pressure area acted on by an interior pressure in the second base pipe segment and an exterior pressure area acted on by an exterior pressure on an exterior of the second pipe segment, creating a negative pressure differential urging the second pipe segment valve toward the open position when the interior pressure is less than the exterior pressure due to suction of the well pump, the interior and exterior pressure areas being selected such that when the negative pressure differential reaches a selected level of the interior pressure less than the exterior pressure, the pressure differential causes the second pipe segment valve to move from the closed position to the open position; and a second pipe segment valve retainer that retains the second pipe segment valve in the closed position until the negative pressure differential reaches the selected level, which indicates that flow through the first screen and the first set of perforations has declined due to clogging of the first screen.

2. The assembly according to claim 1, wherein the second pipe segment valve retainer comprises means for shearing in response to the negative pressure differential reaching the selected second pipe segment valve minimum.

3. The assembly according to claim 1, wherein the second pipe segment valve retainer comprises at least one shear pin.

4. The assembly according to claim 1, wherein the second pipe segment valve comprises a sleeve located between the second screen and the second set of perforations, the sleeve being axially slidable from the closed to the open position.

5. The assembly according to claim 1, further comprising:

a third pipe segment joining an end and extending axially from the second pipe segment;

a third set of perforations in a sidewall of the third pipe segment;

a third screen mounted around the third pipe segment;

a third pipe segment valve mounted to the third pipe segment and having a closed position blocking well fluid flow through the third set of perforations from the third pipe segment into the second pipe segment and to the well pump intake structure, the third pipe segment valve being movable to an open position allowing well fluid flow through the third set of perforations from the third pipe segment into the second pipe segment and to the well pump intake structure;

the third pipe segment valve having an interior pressure area acted on by an interior pressure in the third base pipe segment and an exterior pressure area acted on by an exterior pressure on an exterior of the third pipe segment, creating a third pipe segment valve negative pressure differential urging the third pipe segment valve toward the open position when the interior pressure in the third pipe segment is less than the exterior pressure on the third pipe segment due to suction of the well pump, the interior and exterior pressure areas of the third pipe segment valve being selected such that when the negative pressure differential on the third pipe segment valve reaches a selected level of the interior pressure in the third pipe segment less than the exterior pressure on the third pipe segment, the negative pressure differential on the third pipe segment valve causes the third pipe segment valve to move from the closed position to the open position; and a third pipe segment valve retainer that retains the third pipe segment valve in the closed position until the negative pressure differential acting on the third pipe segment valve reaches the selected level, which indicates that flow through the second screen and the second set of perforations has declined due to clogging of the second screen.

6. The assembly according to claim 5, wherein:

each of the second and third pipe segment valve retainers comprises a shear member arrangement; and the shear member arrangement of the second pipe segment valve retainer is configured to shear at a lesser force than the shear member arrangement of the third pipe segment valve retainer.

7. The assembly according to claim 1, wherein the first pipe segment is configured such that the first set of perforations is continuously open to well fluid flow into an interior of the first pipe segment.

8. The assembly according to claim 1, wherein:

the first set of perforations is located nearer an upper end than a lower end of the first pipe segment; and the sidewall of the first pipe segment is free of perforations from the lower end of the first pipe segment to the first set of perforations.

9. A well fluid particle screen assembly for a well pump, comprising:

a base pipe having axis, a first pipe segment and a second pipe segment, one of the pipe segments being above the other of the pipe segments, the base pipe having an open upper end for attachment to an intake structure of the well pump within a well and a closed lower end;

a plurality of first perforations in a sidewall of the first pipe segment;

a first screen mounted around the first pipe segment filtering well fluid flowing through the first screen along a first flow path through the first perforations into the first pipe segment;

a plurality of second perforations in a sidewall of the second pipe segment, the sidewall of the second pipe segment having a solid cylindrical wall portion that is free of perforations and extending axially from the second perforations;

a second screen mounted around the second pipe segment radially outward from the solid cylindrical wall portion of the second pipe segment, defining a second screen annulus between the second screen and the solid cylindrical wall portion of the second pipe segment;

a cylindrical second pipe segment valve chamber wall at one end of the second screen, the second pipe segment chamber wall being concentric with and radially outward from the second perforations in the second pipe segment, defining a second pipe segment valve chamber, the second pipe segment chamber wall having one end below the second perforations and another end above the second perforations;

a second pipe segment sleeve valve in the second pipe segment valve chamber, the second pipe segment sleeve valve having a closed position blocking flow of well fluid from the second screen annulus to the second perforations and being axially slidable along the second pipe segment valve chamber wall past the second perforations to an open position allowing flow from the second screen annulus through the second perforations;

wherein the second pipe segment sleeve valve has an internal pressure area acted on by an internal pressure in the second pipe segment and an external pressure on the second pipe segment, creating a negative pressure differential urging the second pipe segment valve toward the open position when the interior pressure is less than the exterior pressure due to suction of the well pump, the interior and exterior pressure areas being selected such that when the negative pressure differential reaches a selected level of the interior pressure less than the exterior pressure, the negative pressure differential causes the second pipe segment valve to move from the closed position to the open position; and a second pipe segment sleeve valve retainer that retains the second pipe segment sleeve valve in the closed position until the negative pressure differential reaches the selected level, which indicates that flow through the first screen and the first set of perforations has declined due to clogging of the first screen.

10. The assembly according to claim 9, wherein the first perforations are closer to an upper end of the first pipe segment than a lower end of the first pipe segment, the sidewall of the first pipe segment being free of perforations from the first perforations to the lower end of the first pipe segment.

11. The assembly according to claim 9, wherein the second perforations are closer to an upper end of the second pipe segment than a lower end of the second pipe segment, and the second pipe segment sleeve valve moves upward while moving from the closed position to the open position.

12. The assembly according to claim 11, wherein an upper end of the second screen is located below all of the second perforations.

13. The assembly according to claim 9, wherein the first flow path is continuously open.

14. The assembly according to claim 9, wherein the first pipe segment is located above the second pipe segment.

15. The assembly according to claim 9, wherein the retainer comprises at least one shear pin.

16. The assembly according to claim 9, further comprising:

a third pipe segment joining the second pipe segment;

a plurality of third perforations in a sidewall of the third pipe segment, the sidewall of the third pipe segment having a solid cylindrical wall portion that is free of perforations and extending axially from the second perforations;

a third screen mounted around the third pipe segment radially outward from the solid cylindrical wall portion of the third pipe segment, defining a third screen annulus between the third screen and the solid cylindrical wall portion of the third pipe segment;

a third pipe segment valve chamber wall at one end of the third screen, the third pipe segment valve chamber wall being concentric with and radially outward from the third pipe segment, defining a third pipe segment valve chamber, the third pipe segment valve chamber wall having a lower end below the third perforations and an upper end above the third perforations;

a third pipe segment sleeve valve in the third pipe segment valve chamber, the third pipe segment sleeve valve having a closed position blocking flow of well fluid from the third screen annulus to the third perforations and being axially slidable past the third perforations to an open position allowing flow from the third screen annulus through the third perforations;

wherein the third pipe segment sleeve valve has an interior pressure area acted on by an interior pressure in the third base pipe segment and an exterior pressure area acted on by an exterior pressure on an exterior of the third pipe segment, creating a negative pressure differential urging the third pipe segment valve toward the open position when the interior pressure in the third pipe segment is less than the exterior pressure in the third pipe segment due to suction of the well pump; and a third pipe segment sleeve valve retainer that retains the third pipe segment sleeve valve in the closed position until the negative pressure differential acting on the third pipe segment sleeve valve reaches a selected level, the selected level for the third pipe segment sleeve valve being greater than the selected level for the second pipe segment sleeve valve.

17. A method of pumping well fluid from a well, comprising:

mounting a base pipe to well pump intake structure of a well pump within a well, the base pipe having a first pipe segment and a second pipe segment, one of the segments being above the other of the segments, the base pipe having first and second sets of perforations in sidewalls of the first and second pipe segments, respectively, the base pipe having first and second screens mounted around the first and second pipe segments, respectively, the second pipe segment having a second pipe segment valve with an interior pressure area for exposure to interior pressure in an interior of the second pipe segment and an exterior pressure area for exposure to an exterior pressure on an exterior of the second pipe segment;

operating the pump, creating a suction that results in the interior pressure acting on the interior pressure area that is less than the exterior pressure acting on the exterior pressure area, creating a negative pressure differential that urges the second pipe segment valve from a closed position toward the open position, and flowing well fluid into the base pipe along a first flow path through the first screen and the first set of perforations, and with the second pipe segment valve in the closed position, blocking well fluid flow through the second screen into the second set of perforations while the negative pressure differential is less than a selected level; then when the negative pressure differential reaches the selected level, applying a sufficient force on the second pipe segment valve with the negative pressure differential to move the second pipe segment valve to the open position and flowing well fluid along a second flow path through the second screen and into the second set of perforations.

18. The method according to claim 17, wherein the well fluid contains hydraulic fracturing proppants, and the method further comprises:

configuring each of the first and second screens with a minimum aperture size selected to be greater than an average cross-sectional area of the proppants; and wherein flowing well fluid through the first and second screens comprises metering a flow of the proppants through the first and second screens and into the base pipe.

19. The method according to claim 17, wherein:

the second set of perforations is located above the second screen, and a portion of the second pipe segment from the second set of perforations to a lower end of the second pipe segment is free of any perforations; and the step of flowing well fluid flow along the second flow path comprises flowing the well fluid in an upward direction after it passes through the second screen until reaching the second set of perforations.

20. The method according to claim 17, wherein:

the base pipe has a third pipe segment extending axially from the second pipe segment, the third pipe segment containing a third set of perforations and a third screen mounted around the third pipe segment, the third pipe segment having a third pipe segment valve with an interior pressure area for exposure to interior pressure in an interior of the third pipe segment and an exterior pressure area for exposure to an exterior pressure on an exterior of the third pipe segment;

wherein flowing well fluid into the base pipe along the first flow path while blocking well flow fluid through the second screen into the second set of perforations with the second pipe segment valve also comprises blocking well fluid flow with the third pipe segment valve through the third screen into the third set of perforations;

wherein moving the second pipe segment valve to the open position comprises continuing to block well fluid flow through the third screen into the third set of perforations with the third pipe segment valve; and the method further comprises:

when the internal pressure acting on the third pipe segment valve is less than the exterior pressure acting on the third pipe segment valve by a third pipe segment valve selected level and higher than the second pipe segment valve selected level, causing the pressure difference acting on the third pipe segment valve to move the third pipe segment valve to an open position.

* * * * *